United States Patent [19]

Burke et al.

[11] 4,183,301

[45] Jan. 15, 1980

[54] INDUCTION GROUND MINE AND FIRING MECHANISM THEREFOR

[75] Inventors: Richard J. Burke, Babbitt, Nev.; George Renholt, Jr., Washington, D.C.

[73] Assignee: The United States of America as represented by the Secretary of the Navy, Washington, D.C.

[21] Appl. No.: 548,484

[22] Filed: Aug. 7, 1944

[51] Int. Cl.[2] ..... F42B 22/00; F42B 22/04

[52] U.S. Cl. ..... 102/13; 102/18 M

[58] Field of Search ..... 102/10, 13, 16, 17, 102/18

[56] References Cited

U.S. PATENT DOCUMENTS

| | | | |
|---|---|---|---|
| 1,300,413 | 4/1919 | Kee | 102/13 |
| 1,491,004 | 4/1924 | Duffie | 102/18 |

FOREIGN PATENT DOCUMENTS

| | | | |
|---|---|---|---|
| 803907 | 7/1936 | France | 102/18 |

*Primary Examiner*—Charles T. Jordan

*Attorney, Agent, or Firm*—R. S. Sciascia; A. L. Branning

EXEMPLARY CLAIM

1. In a mine of the character disclosed adapted to be planted on the bed of a body of water from a surface vessel, the combination of a mine casing, a drag plate for the mine adapted to retard the downward movement thereof as the mine descends through the water, means including a line for detachably securing the drag plate to the casing in such a manner as to cause the casing to be righted during the descent of the mine through the water, and means effective when the mine reaches a predetermined depth of submergence for disconnecting the drag plate from the casing.

26 Claims, 12 Drawing Figures

72
94
SC
88
67
71
74
75
76
73
79
92
89
83
82
81
54
58
53
57
55
56
52
49
59
44
70
45
26
48
51
28
47
46
24
21
18
19
25
78
77
74
73
26
33
36
35
22
42
41
43
38
34
39
37
68
69
15
16
29
17
61
63
23
62
65
66
64
85
84
86
82
83
81

INDUCTION GROUND MINE AND FIRING MECHANISM THEREFOR

This invention relates to an induction ground mine and firing mechanism therefor in which the mine is of a type adapted to be planted from a surface vessel and in which means are provided for causing the mine to come to rest in a predetermined position on the bed of a body of water into which the mine is launched. More specifically, the present invention contemplates a mine of the aforedescribed type and a firing mechanism therefor in which the mine is adapted to be fired in response to a pair of electrical signals of opposite polarities and of predetermined time spaced relation induced therein by the vertical component of the magnetic field associated with a vessel in motion.

It is well-known that a vessel acquires a magnetic field having a vertical component during the fabrication and travel thereof in the earth's magnetic field by reason of the shocks or blows received by the iron and steel of the vessel in the fabrication process thereof and by reason of the vibration of the vessel's propulsion mechanism and various control devices employed on the vessel, the shocks and vibration producing molecular changes of magnetic character within the metallic structure of the vessel sufficient to set up a magnetic field thereabout. Accordingly, when the fabrication and travel of the vessel occurs within a region of high magnetic dip in the earth's magnetic field, such, for example, as occurs within the temperate zones of the earth, the field thus acquired by the vessel is characterized by a magnetic axis having a vertical component which is substantially greater than the horizontal component thereof.

It is also well-known that such a vessel increases and decreases the strength of the earth's magnetic field at a fixed point of reference therein as different portions of the vessel move past the reference point. Such changes form a particular magnetic pattern which is referred to in the art as the magnetic signature of the vessel.

When an induction pick-up coil, hereinafter referred to as a search coil, and comprising a relatively large number of turns of wire arranged about an elongated magnetic core, is disposed at the point of reference for the purpose of detecting vessels moving with respect thereto, electrical signals of positive and negative polarities are induced selectively in the search coil when the magnetic field increases and decreases in strength respectively. Accordingly, the search coil serves as a means for inducing electrical signals of opposite polarities selectively in accordance with increases and decreases in the strength of the magnetic field controlled by the magnetic signature of a vessel moving with respect thereto.

Moreover, when the magnetic axis of the search coil is disposed in a vertical direction, the search coil responds only to the vertical component of the changing magnetic field within the vicinity thereof. Accordingly, such vertical disposition of the search coil enables the mine to detect a vessel when the mine is planted in deep water and affords the optimum sensitivity therefor with respect to the detection of a moving vessel for the reason that the vertical component of the vessel's magnetic field is generally greater than the horizontal component, as stated hereinbefore. Furthermore, a mine, in which a vertically disposed search coil is employed to detect the approaching vessel and control the firing of the mine, is adapted to be fired when the vessel moves into a relatively small destructive zone surrounding the mine, which zone corresponds substantially to the magnetic field surrounding the vertical component of the magnetic axis of the vessel. Furthermore, by arranging a search coil with the axis vertical, the sensitivity of the mine to the magnetic field of the vessel is substantially independent of the direction of the approach of the vessel.

In the arrangement of the present invention, a surface planted, induction type ground mine is provided which embodies a practical application of the aforegoing principles in that it comprises a unitary mine case and truck on which a search coil is supported and vertically extended therefrom, and a drag plate is releasably attached to the mine case and to the search coil by a length of line in such a manner as to cause the mine to be righted as the mine descends through the water. During the planting operation, as will appear in greater detail hereinafter, means responsive to the pressure of the surrounding water is employed to disconnect the line and the drag plate from the mine when the mine reaches a predetermined depth of submergence in order to avoid the possibility of the mine being tipped over by tidal currents after the mine comes to rest. The mine preferably is planted in areas in which the bed of the body of water into which the mine is launched is substantially flat in order that the search coil be substantially vertically disposed when the mine comes to rest. The angle of tilt of the coil from the vertical, therefore, in any case, is determined by the contour and character of the bed.

A mine firing mechanism is provided within the mine and comprises a plurality of relay and switch instruments including a sensitive moving coil type relay having a reset magnet such, for example as a relay known in the art as a Sensitrol. The sensitive relay is arranged to respond to signals of either polarity induced in the search coil so as to close selectively a pair of paths or circuits in accordance with the polarities of the induced signals. Closure of either of the circuits initiates the stepping operation of a rotary selector switch having a plurality of contact banks and wipers therefor, and a plurality of control circuits including the switch banks and wipers are arranged in such a manner as to cause the switch to step continuously through one complete rotation or unit cycle of operation thereof.

Step-by-step movement of the selector switch is timed by circuit controlling means including an electro-responsive clock mechanism operable in unit cycles and adapted to provide a relatively short time interval during each such cycle such that the time measured by the switch during one full rotation thereof is relatively long compared to the time between successive steps of the switch. The firing circuit of the mine includes certain banks of the selector switch, which banks are electrically connected in such a manner that the mine is armed during a period of time corresponding to a predetermined fractional portion of the switch movement.

Closure of either of the aforesaid circuits by the sensitive relay also controls the operation of one of a pair of telephone relays respectively controlled thereby, and certain other banks of the selector switch are arranged to maintain the relay operated until a full rotation of the switch has been completed. Each of the telephone relays, when operated, is adapted to close one of a pair of contacts respectively associated therewith, which contacts are connected in series in the time firing circuit such that the firing circuit is closed when the second telephone relay is operated during the aforesaid armed period of the mine.

Closure of either of the aforesaid paths or circuits by the sensitive relay, either at the start of or at any time during the operation of the selector switch, causes the reset magnet of the sensitive relay to be energized whereby the sensitive relay is restored to its neutral position and thereafter released after a relatively short predetermined interval of time, thereby rendering the relay responsive to successive electrical signals induced by the search coil in response to changes in the magnetic field adjacent thereto. However, in order to prevent response of the sensitive relay to successive signals induced in the search coil by the well-known sweep operation of an aircraft, a circuit controlled by the clock mechanism and including one of the selector switch banks is provided to maintain the energization of the reset magnet for an additional period of time after the step-by-step movement of the selector switch has been initiated. The combined time intervals during which the sensitive relay is thus rendered unresponsive during the first part of each cycle of operation of the mechanism preferably is sufficiently long to prevent firing of the mine in response to the aforesaid sweeping operation and is relatively short with respect to the aforesaid armed period of the mine whereby the mine is adapted to detect and destroy a large variety of vessels moving at various speeds, the banks of the selector switch preferably being electrically connected such that the armed period of the mine begins at the end of the initial unresponsive period of the sensitive relay and terminates when the selector switch is returned to the initial position thereof, as will appear in greater detail hereinafter. Thus, by reason of the aforegoing circuit arrangements, the mine is adapted to be fired in response to a pair of successive signals of opposite polarity which occur in predetermined time spaced relation.

As in the case of several prior art mechanisms of this general type, the arrangement is such as to require current from the battery of the mine firing system only during operation of the mechanism, and the life of the mine, therefore, may extend over a relatively long period of time. In the prior art mechanisms, the several component parts thereof usually are energized simultaneously during the operation of the mechanism and the resultant peak current demand on the battery may cause the terminal voltage of the battery to fall below the operating voltages of the several components, particularly in cases when the battery has aged to some extent. In the present mechanism, however, such difficulties are obviated by the provision of circuit arrangements whereby the components which require large currents in the operation thereof are caused to be energized in sequence, thus preventing a heavy peak load on the battery.

Means are provided for preventing firing of the mine in response to sudden shocks received thereby such as are caused by the explosion of other mines or of countermine operations within the vicinity thereof. Such means are arranged to control the energization of the reset magnet of the sensitive relay, to release the aforesaid telephone relays, if operated, and to open the firing circuit of the mine in response to the aforesaid shock, thereby to disarm the mine and to maintain the sensitive relay unresponsive and the firing circuit open for a predetermined period of time of sufficient duration to permit the shocks to subside before the mine is restored to full responsiveness to signals received from the search coil.

An object of the invention is to provide a new and improved underwater ground mine of a type adapted to be planted from a surface vessel and having a unitary mine case and truck therefor.

Another object is the provision of an underwater ground mine of a type adapted to be planted from a surface vessel and in which new and improved means are provided for causing the mine to be retarded during the downward movement thereof through the water and come to rest in an upright position on the bed of a body of water in which the mine is planted.

Another object is the provision of new and improved means for righting an underwater mine as it descends through the water and the provision of additional means responsive to pressure of the surrounding water for releasing the righting means when the mine reaches a predetermined depth of submergence.

Another object is the provision of an underwater ground mine in which means for detecting a vessel moving with respect thereto is employed and new and improved means detachably secured to the mine are provided for causing the mine to come to rest in a predetermined upright position on the bed of a body of water in which the mine is planted whereby the area of response of the detecting device to vessels moving with respect thereto is substantially narrowed.

A further object of the invention is the provision of an underwater magnetic influence ground mine in which new and improved means are provided for causing the magnetic detecting means to be disposed substantially in a vertical position when the mine comes to rest after launching thereof whereby the response of the detecting means is limited to magnetic field changes in a substantially vertical direction.

Another object is the provision of a new and improved induction firing system for a mine which operates to fire the mine in response to successive signals of opposite polarities and which occur in predetermined time spaced relation.

Another object is the provision of a new and improved mine firing system in which means are provided for rendering the system responsive to successive signals of like polarity whereby a successive signal of reverse polarity may be received to cause a firing operation of the system.

Another object is the provision of a mine firing system in which means are provided for energizing a pair of relays selectively in accordance with the polarities of signals received by the system, for maintaining the energization of the first of the relays to be thus energized for a predetermined period of time, and for closing the firing circuit of the mine when the relays are both energized.

Another object in a mine firing system is the provision of new and improved control circuits for substantially reducing the peak current demand on the battery of the system during a cycle of operation of the system.

Another object in a mine firing mechanism, in which a rotary selector switch is employed for measuring a predetermined interval of time, is the provision of new and improved means for timing the step-by-step movement of the selector switch whereby relatively long and short predetermined intervals of time are provided during one full rotation of the switch.

An additional object of the invention resides in the provision of new and improved means for preventing firing of the mine in response to sudden shocks received thereby such as are caused by the explosion of another mine within the vicinity thereof or as the result of a countermine operation.

Still other objects and advantages of the invention not specifically set forth hereinabove are those implied or inherent in the construction, combination and arrangement of parts, as will become more clearly apparent from the following description, reference being had to the accompanying drawings in which.

Figure 1:
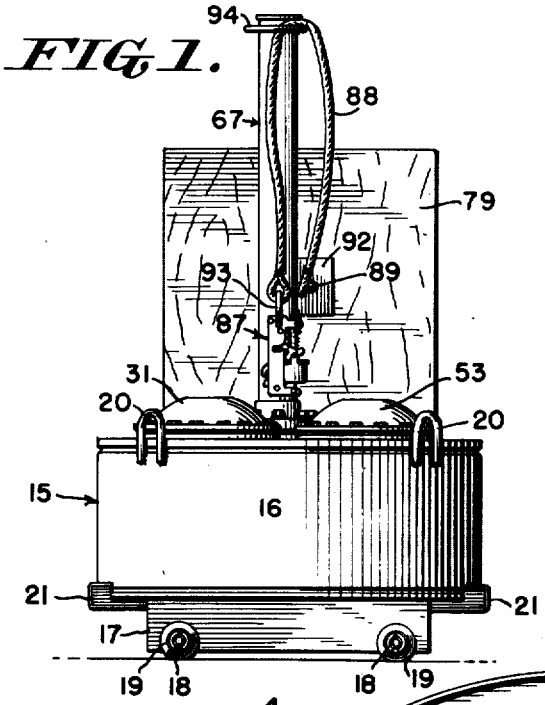
FIG. 1 is a view in elevation of a mine constructed according to a preferred embodiment of the invention.
Figure 2:
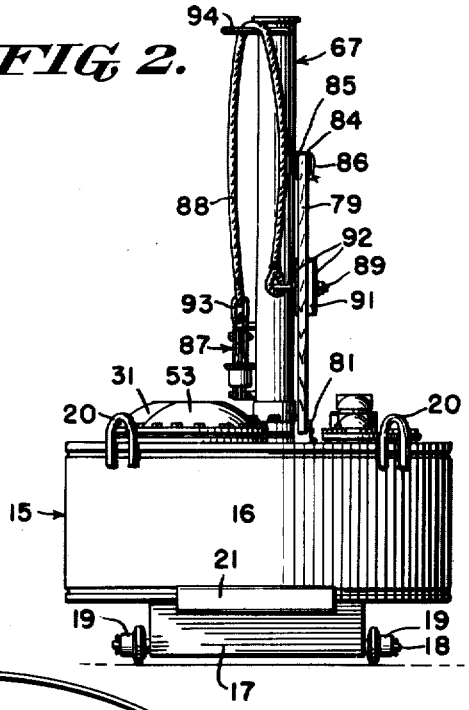
FIG. 2 is a view in elevation of the mine shown in FIG. 1 as viewed from the right side thereof.
Figure 3:
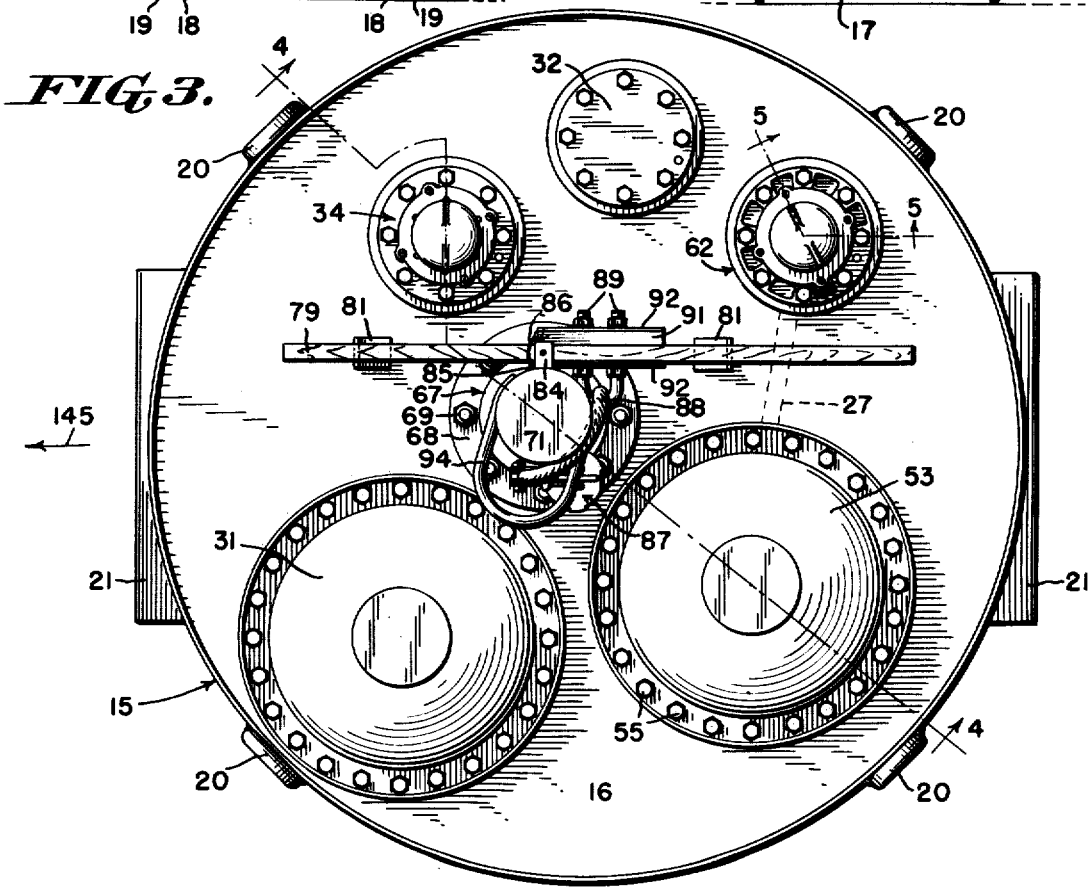
FIG. 3 is a somewhat enlarged plan view of the mine shown in FIG. 1.
Figures 4, 5, 6, 7:
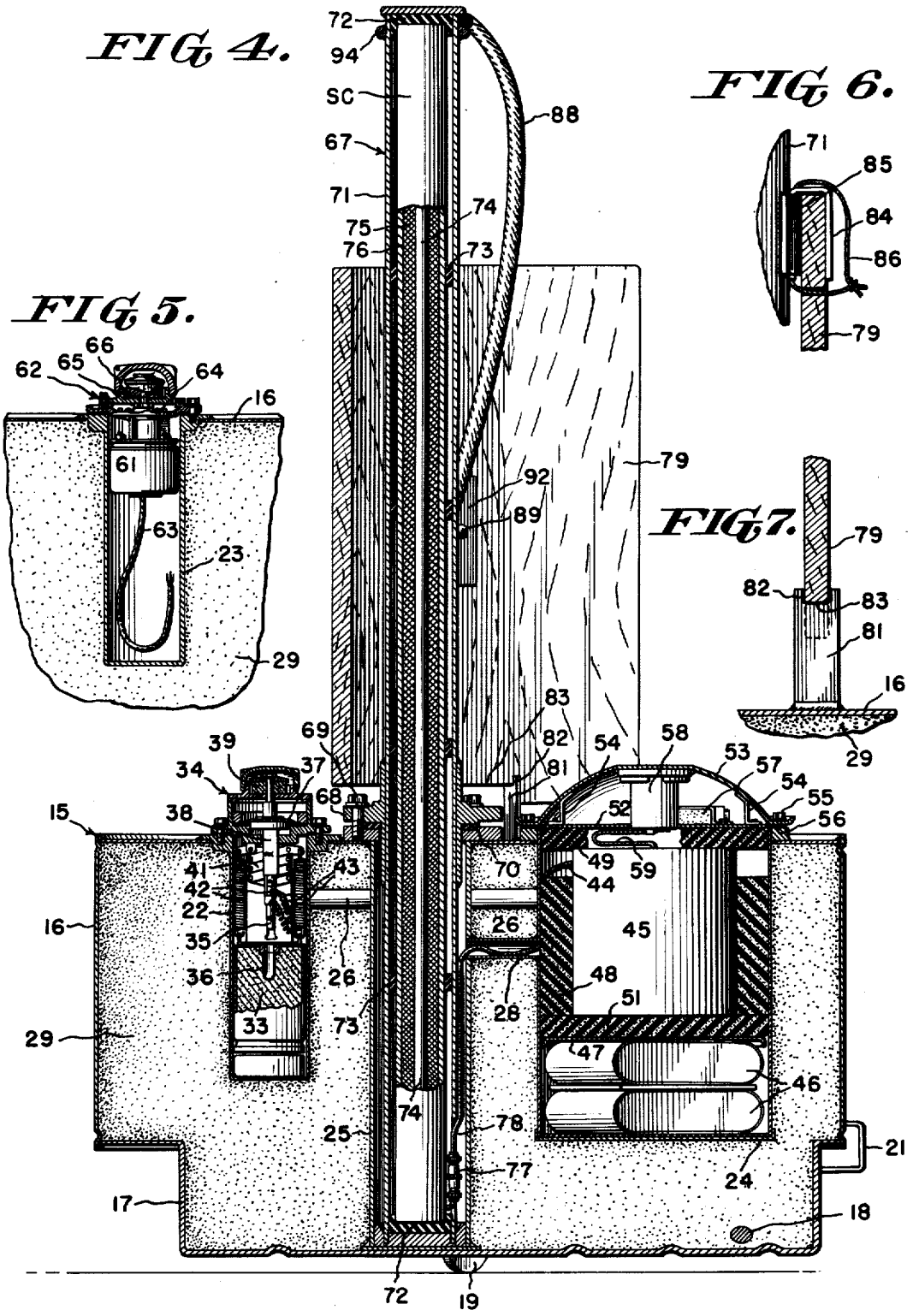
FIG. 4 is a sectional view of the mine taken along the line 4—4 of FIG. 3.
FIG. 5 is a sectional view taken along the line 5—5 of FIG. 3.
FIGS. 6 and 7 are somewhat enlarged fragmentary views of the retaining means for the drag plate at the upper and lower ends thereof respectively.
Figure 8:
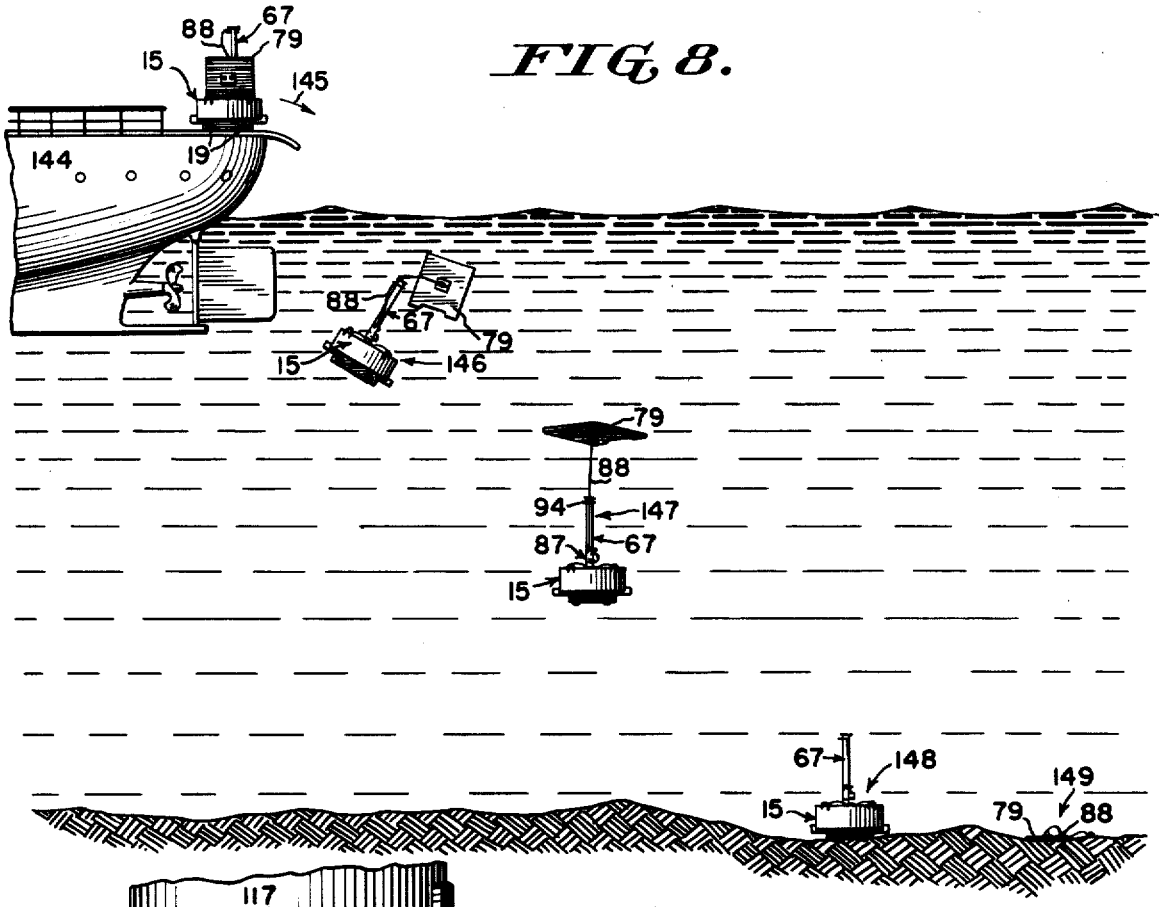
FIG. 8 is a schematic view illustrating several positions of the mine during the launching operation thereof.

Referring now to the drawings for a more detailed description of the invention, the numeral 15 generally designates a mine having a mine case 16 which is generally of cylindrical configuration. The bottom of the mine case, designated 17, however, is shaped in the form of a rectangle and serves as the truck for the mine, axles 18 being secured thereto and extended therethrough to receive flanged rollers 19 adapted to fit standard mine laying tracks. Suitable lifting eyes 20 are secured to the case 16 to facilitate handling of the mine, and suitable bumpers 21 are secured to the end of the truck 17 to maintain adjacent mines in spaced relation on the mine laying tracks.

The case 16 comprises a plurality of vertically disposed wells 22, 23, 24 and 25 which may be welded or otherwise suitably secured to the case in any conventional manner, substantially as shown. Ducts 26, 27 and 28 respectively are extended between well 24 and wells 22, 23 and 25 for a purpose to be disclosed in detail hereinafter. The remaining space within casing 16, is filled with an explosive charge 29, of TNT or the like sufficient to destroy or damage a vessel and to impart a negative degree of buoyancy to the mine whereby the mine is caused to sink through the water and come to rest on the bed thereof, the explosive charge conveniently being admitted into the casing by way of a large watertight filler opening 31, and also by way of a smaller opening 32, if desired.

A booster charge 33 and the extender mechanism 34 usually associated therewith are arranged within the well 22 in watertight relation therein. The extender mechanism may be of any type adapted to move an electroresponsive detonator 35 carried thereby into a cavity 36 provided for the detonator in the booster charge under pressure of the surrounding water acting on the extender mechanism. However, the extender mechanism preferably is of a type, as illustrated, in which the water pressure acting upon a diaphragm 37 causes a plunger 38 to move after a soluable washer 39 is dissolved. Movement of the plunger 38 is multiplied by a lazy tongs 41 which carries the detonator, coil springs 42 being employed to bias the detonator in the nonextended or unarmed position thereof. Leads 43 of the detonator comprise a cable 44 which is extended through the duct 26 to a terminal board, not shown, on a firing mechanism 45 disposed within the well 24.

Also supported within the well 24 are batteries 46 which serve as a source of electrical energy for the firing mechanism 45, the mechanism and batteries being separated by any suitable spacer plate 47. The mechanism 45 is resiliently supported within the well 24 by means of a cushion 48 which extends circumferentially thereabout and by upper and lower cushion members 49, 51 respectively. The mechanism is yieldably held within the cushions by reason of the pressure applied thereto by a plate 52 when the dome-shaped cover 53 is secured to the mine case, plate 52 having brackets 54 adapted to engage the inner surface of the cover. A plurality of bolts 55 preferably is employed to secure the cover to the case, and a suitable gasket 56 is inserted between the cover and case to insure a watertight connection therebetween.

Plate 52 also supports an air dryer 57 which comprises a peforated container which is supplied with any suitable material adapted to absorb moisture from the air, such, for example, as silica gel. Another such air dryer preferably is provided within the housing of the firing mechanism to protect the component parts of the mechanism from damage by moisture.

An anti-countermine device 58, is supported by the cover 53 and secured thereto in any conventional manner. The device 58 comprises an inertia type switch adapted to interrupt and close certain control circuits when the switch closes in response to mechanical shocks received by the mine such as are caused by countermining operations, for example. The control circuits are arranged to effect certain protective operations or functions of the mechanism 45, as will appear in greater detail hereinafter, a multi-conductor cable 59 being connected between the device 58 and the mechanism 45 for this purpose.

A clock mechanism 61 and a hydrostatic clock starter mechanism 62 therefor are arranged within the well 23 in watertight relation therewith. The clock mechanism 61 may be of any type comprising a plurality of contacts adapted to close certain circuits of the electrical system of the mine within predetermined intervals of time after the mine is launched within the water. For this purpose, the clock mechanism preferably is of a type in which a plurality of contacts are operated by a spring and escapement driven cam in the manner disclosed, for example, in the copending application of James B. Glennon et al for Firing Mechanism for a Submarine Mine, Ser. No. 395,230, filed May 26, 1941. The several contacts of the clock mechanism are connected by means of a suitable multi-conductor cable 63 to the terminal board on the mechanism 45 in well 24, cable 63 being extended through duct 27 provided between wells 23 and 24.

Operation of the clock mechanism is initiated by the clock starter mechanism 62 which comprises a flexible diaphragm 64 which operates in response to the pressure of the surrounding water to move a plunger 65 into a position to release the escapement mechanism of the clock after a soluble washer 66 first has been dissolved.

The numeral 67 generally designates a search coil assembly which is supported within the well 25 and provided with a suitable flange 68 by means of which the assembly may be secured to the mine case as by a plurality of bolts 69, a suitable gasket 70 being interposed between the flange and case to insure a water tight connection therebetween.

The search coil assembly 67 comprises a housing 71 to which the flange 68 is welded or otherwise suitably secured thereto. A search coil designated SC is resiliently supported within the housing 71 by means of cup-shaped cushions 72 disposed between the search coil and the ends of the housing and a plurality of ring-shaped cushions 73 disposed at suitable points along the length of the search coil.

The search coil SC comprises an elongated rod of a suitable magnetic material such, for example, as a material known in the trade as Permalloy or Mumetal. A coil 75 comprising a large number of turns of wire is arranged about the rod 74, and the rod and coil are enclosed by a suitable sheath 76. The leads of the coil 75 terminate in a plug and jack connection 77 to which a multiconductor cable 78 is secured. Cable 78 serves to connect the search coil to the firing mechanism 45, the cable being connected to the terminal board thereof and extended through the duct 28. The contacts of the plug and jack connection 77 preferably are formed of precious metal for the reason that extremely small voltages are generated by the search coil in response to small changes in the magnetic field adjacent the search coil, as will appear in greater detail hereinafter.

A drag plate 79 is supported on the mine case 16 on upright brackets 81 welded to the top of the case or otherwise suitably secured thereto, the brackets being notched as at 82 to receive the drag plate thereby to prevent lateral movement thereof and the drag plate being notched at 83 to clear the supporting flange 68 for the search coil and to prevent longitudinal movement of the drag plate with respect to the brackets. The top of the drag plate is releasably secured to the search coil housing 71 by means of a U-shaped clamp 84 which is arranged to be received within a bracket 85 which is welded or otherwise suitably secured to the housing. Clamp 84 serves securely to lock the drag plate in position on the mine during the transit thereof and is removed therefrom just prior to launching of the mine. During the launching operation of the mine, the drag plate, at the top thereof, is secured to the search coil housing as by a cord 86 of such strength as to be broken when the drag plate strikes the water, the drag plate being free to move off of the bracket 81 when the cord is broken. The drag plate preferably is formed of a suitable material such, for example, as bonded waterproof plywood in order to enable it to resist the impact upon striking the water and generally to resist warping and cracking under weather conditions.

The drag plate is also releasably or detachably secured to a hydrostatic release mechanism, generally designated by the numeral 87, by means of a line or rope 88. The line 88 preferably is formed of a suitable material such, for example, as a jute rope having a wet strength sufficient to withstand the strain thereon as the mine descends through the water.

Line 88 is secured to the drag plate by means of a U-bolt 89 which also carries a lead plate 91 and brass supporting plates 92, by means of which lead and brass plates a negative buoyancy is imparted to the drag plate so that it is caused to sink through the water after being released from the mine. The other end of line 88 carries a ring or link 93 which is adapted to be releasably secured to the hydrostatic release mechanism 87. Line 88 necessarily is threaded downwardly from the drag plate through a ring 94 welded or otherwise secured at the top of the search coil housing whereby the drag plate is caused to assume a position above the mine to retard the descent thereof through the water without causing a fouling of the line. This arrangement of the line causes the mine to be righted to a vertical position thereof as the cable becomes taut by reason of the retarding effect on the descent of the mine caused by the drag plate.

The release mechanism 87 serves to release or disconnect the drag plate from the mine when the mine reaches a predetermined depth of submergence such, for example, as 30 feet below the surface of the water. The release mechanism 87 comprises a pair of plates 95, 96 which are mantained in spaced relation with respect to each other and are secured to the search coil housing as by a pair of bolts 97, 98. The release mechanism also comprises an expansible bellows 99, one end of which is pivotally secured between the plates at 101. This end of the bellows also supports a suitable housing 102 therefor which may be perforated or otherwise provided with suitable apertures for admitting water thereinto. The other end of the bellows 99 is pivotally secured as at 103 to a trigger lever 104 which is pivotally supported between plates 95, 96 as at 105. A depth setting spring 106 is connected between trigger lever 104 and an eye bolt 107 which is threadedly supported by a trunnion 108 pivotally supported between the plates 95, 96 as at 109 whereby the tension in spring 106 may be adjusted such that the compression of bellows 99 occurs at a predetermined depth of submergence in the water. Trigger 104 is provided with a laterally extending latch portion 111 which is adapted to lock a bell crank lever 112 against the biasing action of a spring 114. In this position of the bell crank lever, latch portion 113 thereof is adapted to lock a release lever 115 against the biasing action of a coil spring 116 connected between the release lever and the trigger lever 104. Release lever 115 is provided with a hook portion 117 adapted to coact with notches 118 formed in plates 95, 96 to form a normally closed eye 119 in which the line ring 93 is releasably secured. Levers 112 and 115 conveniently may be supported for pivotal movement about the bolts 97, 98 respectively or otherwise pivotally supported between plates 95, 96 in any suitable manner.

Figure 9:
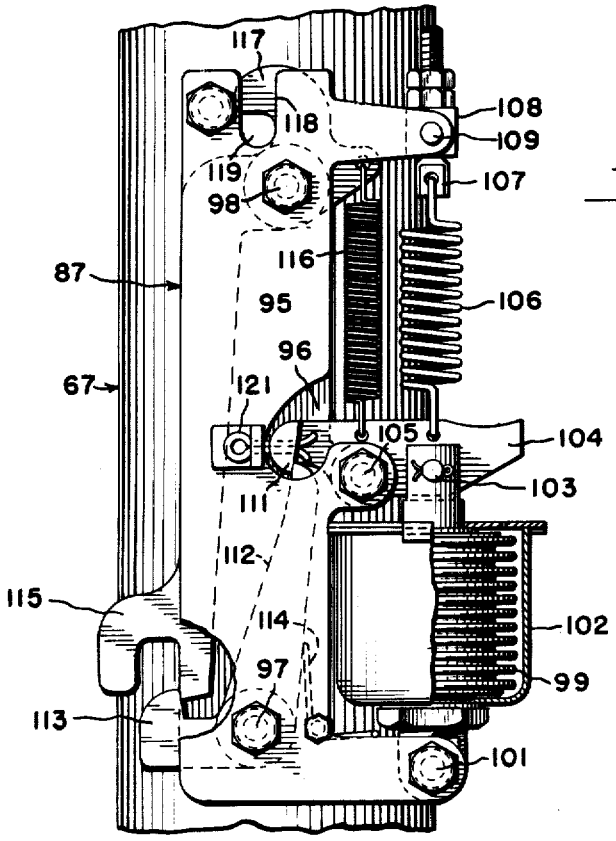
FIG. 9 is an enlarged view in elevation of the hydrostatic release mechanism for the drag plate.

Trigger lever 104 is normally retained in the locked position thereof, as illustrated in FIG. 9, by means of a cotter pin 121 which is removed just prior to launching the mine. When the mine reaches the depth of submergence at which the drag plate is to be released therefrom, compression of bellows 99 causes trigger 104 to move clockwise about pivot 105, as viewed in FIG. 9, thereby releasing bell crank lever 112 which now moves counter clockwise about pivot 97 under power of spring 114. Movement of lever 112 releases lever 115 which now moves clockwise under power of spring 116, thus causing hooked portion 117 to open eye 119 and release the ring 93 therefrom.

Figure 10:
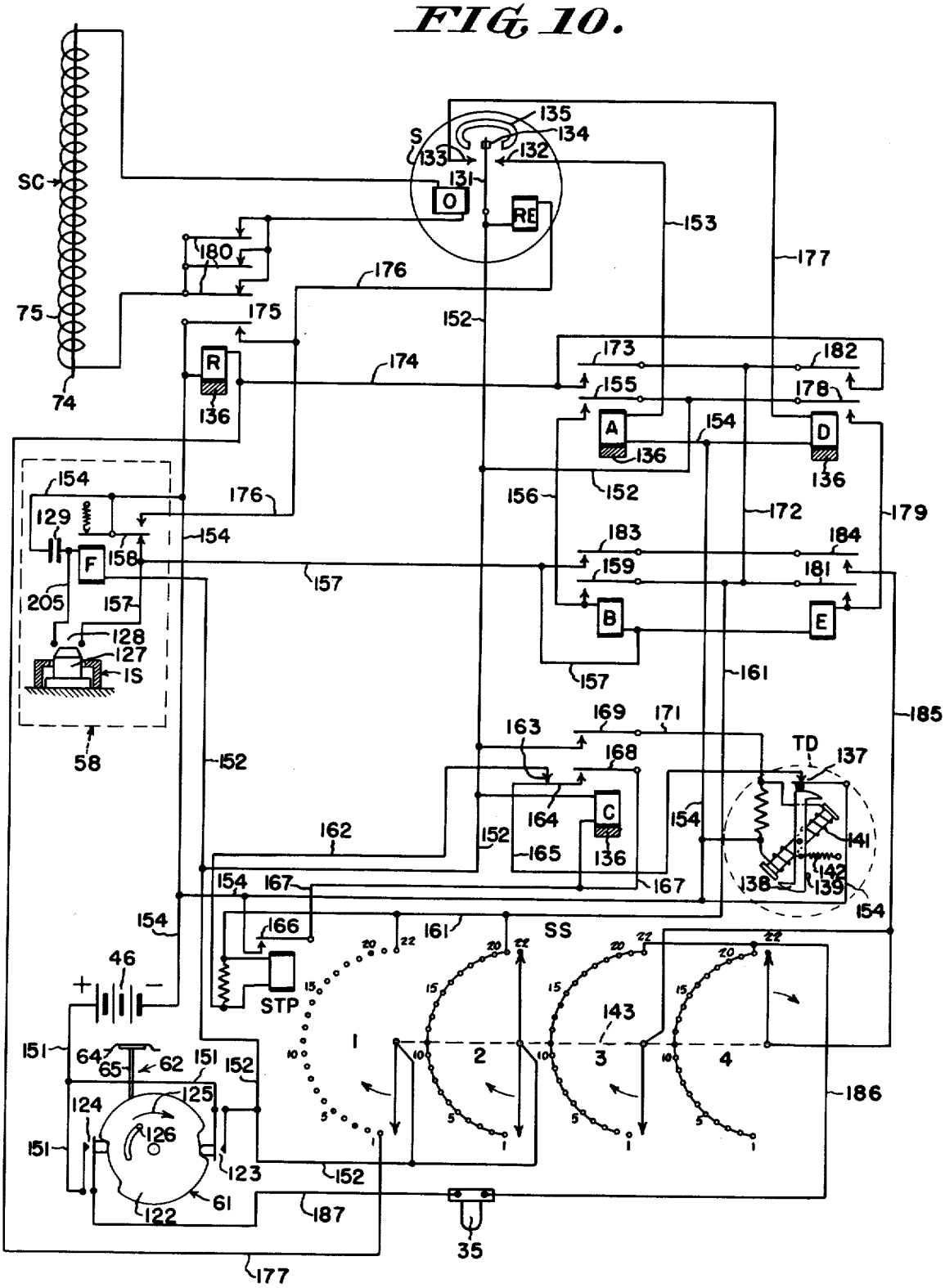
FIG. 10 is a diagrammatic view of a complete electrical system for the mine according to a preferred embodiment thereof; and, FIGS. 11 and 12 are chronographic diagrams illustrating various time intervals during one cycle of operations of the mechanism.

Referring now to FIG. 10 of the drawings in which the several electrical parts of the mine firing system are illustrated diagrammatically, it will be seen that the clock mechanism 61 comprises an escapement driven cam 122 adapted to close in predetermined sequence a pair of contacts 123, 124 when the cam moves in the direction of arrow 125 to engage a stop pin 126.

The aforedescribed anti-countermine device 58 comprises an inertia switch IS which may be of a type disclosed in the copending application of Seth W. Booth for Inertia Switch and Means Controlled Thereby, Ser. No. 484,854, filed Apr. 28, 1943. However, the inertia switch IS preferably is of a type, as illustrated, in which the switch comprises a hammer 127 adapted to move between a pair of contacts 128 in response to mechanical shocks received by the mine, thereby to maintain such contacts closed for a period of time proportional to the severity of the shocks received. Contacts 128, when closed, are arranged to discharge a condenser 129 and to energize a fast operate relay generally designated by the letter F. Relay F operates to interrupt the discharge circuit to the condenser and to control certain protective circuits hereinafter to be described. Condenser 129 then charges through the relay to maintain the operation thereof for a predetermined interval of time measured by the charging time of the condenser. The aforedescribed arrangement and operation of relay F and condenser 129 is substantially as described and claimed in the copending application of John F. Toomey, for means for Disarming a Mine, Serial No. 577,400, filed Feb. 12, 1945.

The letter S generally designates a sensitive relay having a moving coil O adapted to move between the poles of a permanent magnet, not shown, such that an armature 131 carried by the moving coil is moved selectively into engagement with fixed contacts 132, 133 in accordance with the polarity of the current flowing in the moving coil, such movement being accomplished when a current such, for example, as 1.5 microamperes flows through the coil. The armature 131 carries a magnetic keeper 134 which is adapted to be locked to a permanent magnet 135 when the armature engages either of the fixed contacts 132, 133. Relay S also comprises a reset magnet RE having means for releasing the armature from the magnet 135 and for restoring the armature to the mid position between the fixed contacts, the armature being released by the reset magnet for movement with the moving coil O when the reset magnet is deenergized.

Letters A, C, D, and R generally designate telephone type relays each of which provides time delays in the operation and release of the armature thereof by reason of the provision of a copper sleeve or slug 136 arranged about the core of the relay whereby the armature of the relay operates within an interval of time such, for example, as 0.1 seconds and the armature is released after an interval of time such, for example, as 0.25 seconds after the relay is deenergized. Letters B and E generally designate telephone type relays which are generally of the same type as the aforedescribed telephone relays except that relays B and E are not provided with copper slugs and accordingly do not provide appreciable time delays in the operation and release of the armatures thereof.

The letters TD generally designate a time delay relay or mechanism having a pair of normally closed contacts 137 adapted to be opened upon the movement of an armature 138 away from a stop pin 139 when the operate coil 141 of the relay is energized, the armature normally being urged into engagement with the stop pin 139 by means of a biasing spring 142. Relay TD may be of any type adapted to move the contact thereof to a closed position after a predetermined period of time has elapsed immediately following the deenergization of the operate winding thereof. For this purpose, the relay may be any well-known type of construction in which a time delay mechanism comprising a gear train and escapement mechanism or the like is employed to delay the closing of the relay contact for the aforesaid predetermined period of time.

The letters SS generally designate a rotary selector switch having four banks of contacts designated 1 through 4 respectively. Banks 1, 3 and 4 have single ended wipers associated therewith and bank 2 has a double ended wiper associated therewith, the wipers being secured to a common shaft 143 for rotation therewith and being arranged in circumferentially spaced relation with respect to each other and with respect to their several banks, as illustrated. Switch SS is of a type in which the wipers or brushes thereof are stepped ahead to the next succeeding contact of the switch banks when the stepping magnet designated STP is deenergized. Switch is also of a type in which the wipers thereof are preferably of the bridging type adapted to engage the next succeeding terminal or contact of their respective switch banks during the stepping operation of the switch before being moved out of engagement with the preceding bank terminal.

Having fully described the various mechanical and electrical parts of the mine 15, the operation thereof will now be described, the launching operation being first considered. The numeral 144 generally designates a mine layer having suitable tracks, not shown, for receiving the mine and guiding the same off of the mine layer in the direction of arrow 145, the U-shaped clamp 84 and the cotter pin 121 first being removed from the drag plate 79 and the release mechanism 87 respectively, and the drag plate being arranged on the mine such that the U bolt 89 on the drag plate is disposed behind the search coil housing, thereby to prevent a fowling of the cable 88 as the mine descends through the water, as explained in the aforegoing.

Accordingly, when the mine strikes the water, the impact breaks the cord 86 holding the drag plate thereto, thus releasing the drag plate from the mine and causing it to assume a position with respect to the mine as indicated generally at 146. The drag plate is now in a position to create a retarding effect on the mine as it descends through the water. This causes the line 88 to become taut and to align the search coil housing therewith, thereby to right the mine as indicated generally at 147. Accordingly, when the mine reaches a depth of submergence at which the hydrostatic release mechanism 87 operates to disconnect the line 88 from the mine, the mine continues its descent in an upright position and comes to rest on the bed of the water with the search coil assembly 67 substantially vertically disposed, this position of the mine being indicated generally at 148. The drag plate 79, being negatively buoyant, comes to rest on the bed of the water as indicated generally at 149.

When the soluble washers associated with the extender mechanism 34 and the clock starter mechanism 62 have become dissolved after an interval of time of sufficient duration to permit the mine layer 144 to move safely outside the destructive zone of the mine, the extender mechanism 34 operates under pressure of the surrounding water to move the detonator 35 into the cavity 36 therefor in the booster charge 33 and the clock starter mechanism 62 operates under pressure of the surrounding water to set the cam 122 in motion.

After a first predetermined interval of time measured by the clock mechanism 61, contacts 123 thereof close to apply positive battery from the positive terminal of battery 46 by way of a conductor 151 and contacts 123 to a conductor 152. Accordingly, in the event that armature 131 of relay S has been moved into engagement with either of its coacting fixed contacts 132, 133 by reason of the shock received by the mine upon impact with the water, which engagement of the contacts is extremely probable in view of the fact that the relay S is slightly damped to provide a high degree of sensitivity to currents of small magnitude caused to flow through the operate winding O thereof, a circuit for operating relay A is completed by way of positive battery on conductor 152 by way of armature 131 and fixed contact 132 of relay S, for example, a conductor 153, winding of relay A, and thence by way of a conductor 154 to the negative terminal of battery 46, thereby to operate relay A.

Operation of relay A causes relay B, stepping magnet STP of switch SS, relay C and time delay mechanism TD to operate in sequence, thereby to cause the wipers of switch SS to step ahead one step, and also causes relay R and reset magnet RE of sensitive relay S to operate in succession, thereby to restore the armature 131 of relay S to the neutral or mid position thereof between the fixed contacts 132, 133. Whereas these operations occur concurrently, it will, of course, be necessary to describe them successively, the operations which cause the wipers of switch SS to be stepped ahead first being considered.

As armature 155 of relay A engages its make contact, a circuit for operating relay B is completed from positive battery on conductor 152 by way of armature 155 and make contact of relay A, conductor 156, winding of relay B, conductor 157, and thence by way of armature 158 and break contact of relay F to negative battery on conductor 154, thereby causing relay B to operate. As armature 159 of relay B engages its make contact, a circuit for operating stepping magnet STP of switch SS is completed from positive battery on conductor 152 by way of armature 155 and make contact of relay A, conductor 156, make contact and armature 159 of relay B, conductor 161, the winding of stepping magnet STP, conductor 162, contact 163 and contact spring 164 of relay C, conductor 165, normally closed contacts 137 of mechanism TD, and thence by way of conductor 154 to the negative terminal of battery 46, thereby causing stepping magnet STP to operate. As armature 166 of stepping magnet of STP engages its make contact, a circuit for operating relay C is completed from positive battery on conductor 152 by way of the winding of relay C, conductor 167, armature 166 and make contact of stepping magnet STP and thence by way of conductor 154 to the negative terminal of battery 46, thereby causing relay C to operate.

The contact arrangement of relay C is such that armature 168 thereof engages contact 164 before contact spring 164 disengages from contact 163, after which armature 169 engages its make contact, as relay C operates. Accordingly, a circuit for maintaining the operation of relay C from positive battery on conductor 152 by way of the winding of relay C, conductor 167, armature 168 and contact 164 of relay C, conductor 165, and thence by way of the normally closed contacts 137 of relay TD to negative battery on conductor 154 is completed before contacts 163 and contact spring 164 of relay C disengage to interrupt the operate circuit previously traced to the stepping magnet STP, the operate circuit to relay C previously traced through armature 166 and make contact of magnet STP being interrupted as the stepping magnet releases. As stepping magnet STP of switch SS releases, wipers 1 through 4 thereof are caused to step ahead one step, wipers 1 through 3 moving into engagement with contacts 1 of their respective contact banks and wiper 4 moving out of engagement with contact 22 of its respective bank.

As armature 169 of relay C engages its make contact, a circuit for operating relay TD is completed from positive battery on conductor 152 by way of make contact and armature 169 of relay C, conductor 171, winding 141 of relay TD, and thence by way of conductor 154 to the negative terminal of battery 46, thereby to operate relay TD. As armature 138 of relay TD moves away from stop pin 139, contacts 137 thereof open to interrupt the maintaining circuit to relay C previously traced through armature 168 and make contact thereof. Relay C, however, does not release for approximately .25 seconds after the operate circuit thereto is interrupted by reason of the copper slug 136 thereon, thereby providing sufficient time to permit complete movement of armature 138 of relay TD before the operate circuit thereto previously traced through armature 169 and make contact of relay C is interrupted as relay C releases.

By reason of the provision of the aforedescribed contact arrangement of relay C and the circuit arrangements controlled thereby for causing the stepping magnet STP to operate and release, the stepping magnet STP and time delay mechanism, TD, which magnet and delay mechanism require large currents in the operations thereof, are caused to be energized in sequence, thus preventing a heavy peak current load on the battery 46.

As the operate circuit to winding 141 of mechanism TD is interrupted as relay C releases, armature 138 of mechanism TD releases to drive an escapement mechanism, not shown, under power of spring 142. Accordingly, after a predetermined interval of time such, for example, as 2.25 seconds, armature 138 moves into engagement with stop 139, in which position of the armature, contacts 137 again are closed. Before describing the circuits established by the closing of contacts 137, however, the operations of relays A, B, and R and reset magnet RE in causing the sensitive relay S to be reset will first be described.

As armature 159 engages its make contact of relay B, a circuit for operating relay R is closed from positive battery on conductor 152 by way of armature 155 and make contact of relay A, conductor 156, make contact and armature 159 of relay B, conductor 172, armature 173 and make contact of relay A, conductor 174, and thence by way of the winding of relay R to negative battery on conductor 154, thereby causing relay R to operate. As armature 175 engages its make contact of relay R, a circuit for operating reset magnet RE of sensitive relay S is completed from positive battery on conductor 152 by way of the winding of reset magnet RE, conductor 176, and thence by way of make contact and armature 175 of relay R to negative battery on conductor 154, thereby causing reset magnet RE to operate and forcibly to restore contact element or armature 131 of relay S to a mid position between fixed contacts 132, 133 thereof.

As armature 131 moves out of engagement with contact 132 of relay S, the circuit, previously traced for operating relay A, is interrupted, relay A, however, is not released until approximately 0.25 seconds after the operate circuit thereto is interrupted by reason of the copper slug 136 thereon. Accordingly, the interruption of the operate circuit to relay R, previously traced through make contact and armature 173 of relay A, and the interruption of the circuit for initiating the operation of stepping magnet STP, previously traced through make contact and armature 155 of relay A, is delayed for approximately 0.25 seconds, thereby to insure a complete operation thereof.

Relay R also does not release until approximately 0.25 seconds after the operate circuit thereto has been interrupted by reason of the slug 136 thereon. Operation of relay R, however, is maintained through a circuit completed by wiper 1 and contact 1 of switch SS, this circuit being traced as follows: from positive battery on conductor 152 by way of contact 1 and wiper 1 of switch SS, conductor 177, and thence by way of winding of relay R to negative battery on conductor 154, this circuit being interrupted when the wipers of switch SS move into engagement with contacts 2 of their respective banks. Switch SS is caused to make this step, as will appear hereinafter, when contacts 137 of mechanism TD closed at the end of the 2.25 second interval provided thereby. Thus, the energization of reset magnet RE is maintained and armature 131 of relay S is restrained in the mid position thereof during the first part of each cycle of operations of switch SS for a combined interval of time provided by the time per step of switch SS, controlled by mechanism TD, and the release time of relay R, the combined interval being approximately 3 seconds. This initial, combined interval, as will appear in greater detail hereinafter, is provided for the purpose of preventing operation of operate winding O of relay S in response to changes in the magnetic field adjacent to the search coil SC caused by the sweeping operation of an aircraft. Protection for this purpose also is afforded by the armatures 180 and break contacts of relay R which operate to interrupt an obvious circuit between the search coil SC and the operate winding O of relay S, as relay R operates. Interruption of this circuit, prevents the storing of inductive energy in the search coil SC by reason of changes in the magnetic field adjacent thereto, thereby preventing movement of movable coil O, which movement otherwise might occur upon dissipation of such energy after armature 131 of relay S is released by reset magnet RE thereof.

Extremely small voltages are generated by the search coil, and for this reason, three switches 180 are arranged in parallel to insure that at least one of the parallel switches invariably closes effectively to complete the search coil circuit when relay R is deenergized.

It will be noted that wipers 1 and 2 of switch SS are electrically connected to positive battery on conductor 152 and are electrically connectable to contact 22 of bank 1 and contacts 1 through 21 of bank 2 respectively, and that these contacts are electrically connected by way of conductor 161 to one terminal of the winding of stepping magnet STP, thereby providing an arrangement in which positive battery is applied to this terminal of the stepping magnet continuously as the switch steps forward through 43 steps, or one complete rotation, to the initial or home position thereof. Accordingly, with the wiper of switch SS in any position except the home position thereof, a circuit for operating stepping magnet STP is completed each time contacts 137 of mechanism TD close at the end of the 2.25 second interval provided thereby, this circuit being traced as follows: from positive battery on conductor 152, by way of wiper 1 and contact 22 of bank 1 or contacts 1 through 21 of bank 2 and wiper 2, as the case may be, conductor 161, winding of stepping magnet STP, conductor 162, contact 163 and contact spring 164 of relay C, conductor 165, and thence by way of normally closed contacts 137 of mechanism TD to negative battery on conductor 154. Operation of stepping magnet STP causes relay C and mechanism TD to operate in succession, as decribed in the aforegoing, thereby causing the operate circuit to the stepping magnet to be interrupted whereby the wipers of switch SS are caused to make an additional step, these operations and releases of the stepping magnet being repeated a sufficient number of times to restore the switch SS to the home position thereof, in which position further movement of the switch must be initiated by movement of armature 131 of relay S into either one of the fixed contacts 132, 133 thereof.

Wiper 1 and contact 22 of bank 1 and wiper 2 and contacts 1 through 21 of bank 2 also serve to maintain the operation of relay B during one complete rotation or cycle of operations of switch SS, this circuit being traced as follows: from positive battery on conductor 152 by way of wiper 1 and contact 22 of bank 1 or wiper 2 and contacts 1 through 21 of bank 2, as the case may be, conductor 161, armature 159 and make contact of relay B, winding of relay B, conductor 157, and thence by way of break contact and armature 158 of relay F to negative potential on conductor 154.

In the event that armature 131 engages contact 133 of relay S as the mine is launched into the water, a circuit for operating relay D is completed from positive battery on conductor 152 by way of armature 131 and contact 133 of relay S, conductor 177, and thence by way of winding of relay D to negative battery on conductor 154, thereby to operate relay D. As armature 178 of relay D engages the make contact thereof, a circuit for operating relay E is completed from positive battery on conductor 152 by way of armature 178 and make contact of relay D, conductor 179, winding of relay E, conductor 157, and thence by way of break contact and armature 158 of relay F to negative battery on conductor 154, thereby to operate relay E. As armature 181 of relay E engages its make contact, positive battery on conductor 152 is applied by way of armature 178 and make contact of relay D, conductor 179, make contact and armature 181 of relay E, and thence to conductor 161, thereby to complete a circuit for initiating the operation of stepping magnet STP in the same manner as when relays A and B operate in sequence, as previously described. Also, as relay E operates, positive battery on conductor 152 is applied to conductor 174 by way of armature 178 and make contact of relay D, conductor 179, make contact and armature 181 of relay E, conductor 172, and thence by way of armature 182 and make contact of relay D to conductor 174, thereby to complete a circuit for operating relay R in the same manner as when relays A and B operate in sequence, as previously described. With switch SS in operation, a circuit for maintaining the operation or relay E during one cycle of operations of switch SS is completed by way of banks 1 and 2 thereof in the same manner as for relay B, as previously described.

In the event that either of relays B or E is caused to operate, when switch SS has been set in operation by the other of the relays and at a time when the wipers of switch SS are in any position on the banks thereof except the home position and contacts 1 thereof, a circuit is completed for applying negative battery to one terminal of detonator 35 by way of negative battery on conductor 154, armature 158 and break contact of relay F, conductor 157, make contact and armature 183 of relay B, armature 184 and make contact of relay E, conductor 185, wiper 3 and contacts 2 through 22 of bank 2 or wiper 4 and contacts 1 through 21 of bank 4 of switch SS, as the case may be, and thence by way of conductor 186 to detonator 35, wipers 3 and 4 of switch SS being electrically connected and contacts 2 through 22 of bank 3 and contacts 1 through 21 of bank 4 being electrically connected.

A circuit for energizing detonator 35, however, is not completed from battery 46 for the reason that positive battery is not applied to the detonator until contacts 124 of clock mechanism 61 close after a predetermined interval of time of sufficient duration to restore switch SS to the home position thereof following closure of contacts 123 of the clock mechanism. Accordingly, the mine firing circuit is partially armed as clock contacts 124 close at the end of this predetermined interval, positive battery then being applied to the other terminal of detonator 35 by way of positive battery on conductor 151, contacts 124 of clock mechanism 61, and thence by way of conductor 187 to the detonator, the mine firing system thereafter being armed when either of relays B or E is caused to operate and the wipers of switch SS are caused to move into engagement with contacts 2 of their associated switch banks.

Figure 11:
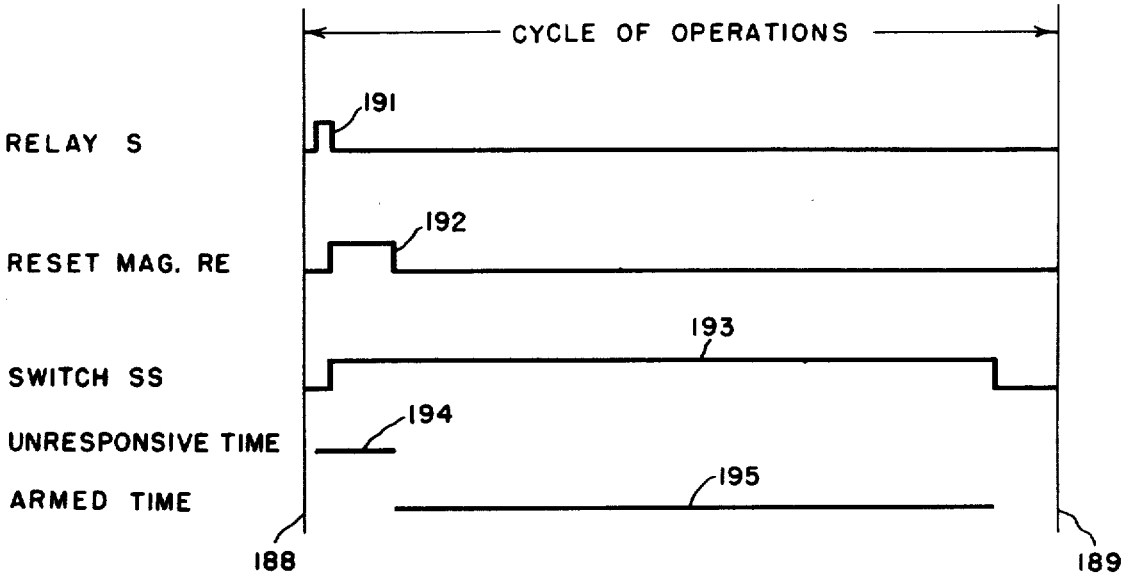

The operation of the mechanism thus far considered, is illustrated graphically in FIG. 11 in which the spacing of the vertical lines 188 and 189 indicates the time of one cycle of operations of the mechanism. Engagement of armature 131 of relay S with either of the fixed contacts 132, 133 thereof is indicated by the raised line portion 191, and operations of reset magnet RE and of switch SS initiated by such engagement are indicated by the raised line portions 192, 193 respectively. It will be noted that switch SS is restored to the home position thereof before the termination of one unit cycle of operations of the mechanism, the cycle being terminated approximately 2.5 seconds after the switch is restored to the home position thereof, during which time relay C releases and mechanism TD thereafter unwinds to restore contacts 137 thereof to closed position.

The total time during which armature 131 of relay S is locked to either of the fixed contacts thereof, as indicated at 191, and is locked in the mid-position between the contacts by reset maganet RE, as indicated at 192, comprises the initial unresponsive time of relay S indicated at 194. The armed time of the mechanism, indicated at 195, is arranged to begin upon release of armature 131 of relay S at the end of the unresponsive interval 194, the firing circuit to detonator 35, previously traced, at this time being complete except for the operation of relays B or E, as the case may be. The armed time 195, of course, terminates when switch SS moves into the home position thereof, it being recalled that the firing circuit includes banks 3 and 4 of switch SS.

With the wipers of switch SS in the home position thereof and with the armature 131 of relay S in the neutral position midway between the fixed contacts thereof, the mine is in readiness to respond to a vessel moving within the vicinity thereof. Let it be assumed, by way of example, that the vessel has a magnetic signature such that the vertical component of the magnetic field adjacent search coil SC increases and decreases as the vessel moves with respect thereto whereby electromotive forces selectively are induced in the search coil of sufficient magnitude and duration to force currents of either polarity and of approximately 1.5 microamperes through the operate winding O of relay S, armature 131 of relay S being caused to engage either of its fixed contacts selectively in accordance with the polarity of the current thus caused to flow through operate winding O.

Figure 12:
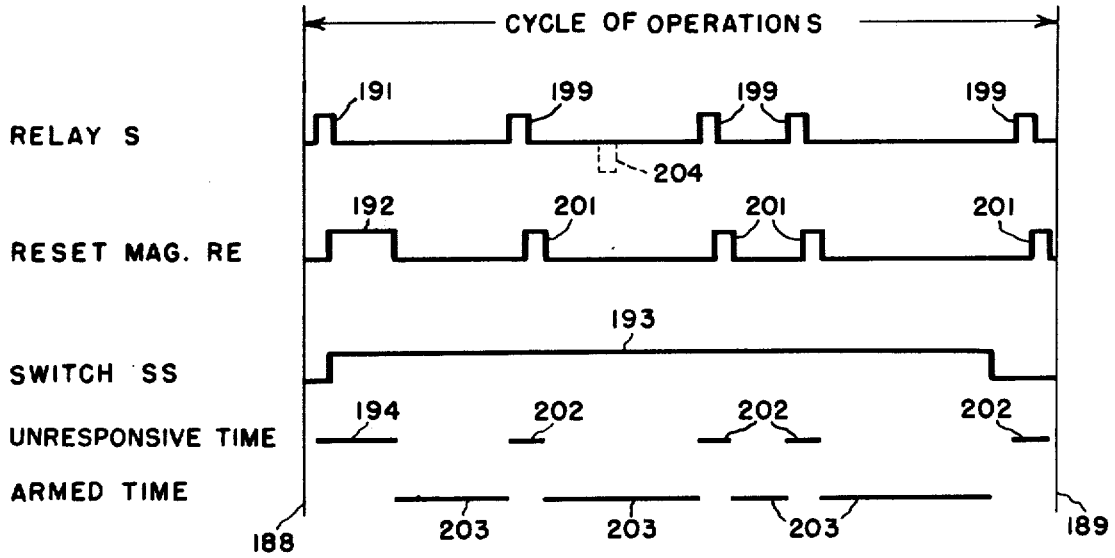

Let it be assumed that the first signal induced in the search coil by the vessel is such as to cause armature 131 to engage fixed contact 132 of relay S, as indicated at 191 on the chronographic diagram of FIG. 12, which diagram is generally similar to the chronographic diagram illustrated in FIG. 11. Closure of contacts 131 and 132 of relay S causes relays A and B to operate in succession, thereby to initiate the operation of switch SS indicated at 193 and to initiate the operation of reset magnet RE as indicated at 192, the operation of reset magnet RE being maintained by switch SS during the engagement of the wipers with contacts 1 of their respective contact banks.

At the end of the unresponsive time of relay S, indicated at 194, operate winding O of relay S is again free to respond to a signal generated by search coil SC. Let it be assumed that the second signal generated by the search coil SC in response to the movement of the vessel with respect thereto also causes armature 131 to engage contact 132 of relay S, thereby causing relays A and R and the reset magnet RE to operate in sequence to interrupt the operate circuit to relay A, relay B being maintained in operation through a circuit established by switch SS, as described in the aforegoing. Interruption of the operate circuit to relay A causes relays A and R to release in succession, thereby causing the reset magnet to release approximately 0.5 seconds after armature 131 of relay S is restored to the mid position thereof, such time being of sufficient duration to stabilize the armature in such position.

The aforegoing operations of relay S and reset magnet RE are indicated by the raised line portions 199 and 201 respectively. During the time of these operations, indicated at 202, relay S is unresponsive to additional signals generated by search coil SC, and, accordingly, the armed time of the mechanism, as indicated by the dash line 203, is shortened to this extent. In like manner, response to relay S to additional signals of like polarity during a unit cycle of operations of the mechanism, produces additional intervals 202 during which the relay S is unresponsive to signals generated by the search coil SC, and the intervals thus introduced diminish the armed time accordingly.

In the event that a signal of opposite polarity is generated by the search coil SC during the armed time 203 of the mechanism, armature 131 engages fixed contact 133 of relay S, thereby to cause relays D and E to operate in succession. As armature 184 engages make contact to relay E, the aforedescribed firing circuit to detonator 35 is completed, thereby to fire and explode the mine beneath a vulnerable portion of the vessel. It will be understood, of course, that the polarity of the signals generated by search coil SC may be such as to cause relays D and E to be operated in response to the first signal generated by the search coil and relays A and B thereafter to be operated in response to a successive signal of opposite polarity occurring in proper time spaced relation to the first signal, thereby to fire and explode the mine.

The operation of the mechanism in response to countermine shocks received by the mine will now be considered. As hammer 127 of switch IS moves to close contacts 128 thereof, a circuit is completed momentarily for operating relay F and a second circuit is completed for discharging condenser 129, the circuit to relay F being completed from positive battery on conductor 152 by way of the winding of relay F, a conductor 205, contacts 128 of switch IS, conductor 157, and thence by way of break contact and armature 158 of relay F to negative battery on conductor 154, and the circuit for discharging condenser 129 being completed from one side thereof by way of conductor 205, contacts 128 of switch IS, conductor 157, break contact and armature 158 of relay F, and thence by way of conductor 154 to the other side of condenser 129, thereby to operate relay F and discharge condenser 129 respectively, it being understood that condenser 129 charges through relay F as contacts 123 of clock mechanism 61 close.

As armature 158 of relay F engages its make contact, the circuits for operating and maintaining the operation of relays B and E and the firing circuit for the detonator 35, previously traced through armature 158 and break contact of relay F, are interrupted as relay F operates. Also, as armature 158 engages make contact of relay F, a circuit for operating reset magnet RE is completed from positive battery on conductor 152 by way of the winding of reset magnet RE, conductor 176, thence by way of make contact and armature 158 of relay F to negative battery on conductor 154, thereby to operate reset magnet RE. As the discharge circuit to condenser 129 is interrupted as relay F operates, the condenser charges through relay F from positive battery on conductor 152 by way of the winding of relay F, condenser 129 and thence to negative battery on conductor 154, thereby to maintain the operation of relay F for a period of time such, for example, as three seconds as determined by the RC constant of relay F and condenser 129, such time being of sufficient duration to permit disturbances caused by the shocks to subside in the vicinity of the mine.

In the event that the countermine shock occurs at a time when switch SS is in operation, interruption of the maintaining circuit to relays B or E, as the case may be, releases the relay and prevents the operation thereof, as armature 158 engages break contact of relay F at the end of the aforesaid three second interval, for the reason that the maintaining circuit to the relay is completed through the contacts thereof. Thus, the mine firing circuit is unarmed to response to a countermine shock which occurs when the switch SS is in operation. The switch SS, however, continues to advance toward its home position.

The operation of the mechanism in response to the sweep operations of an aircraft will now be considered. It is the practice to apply sweeping apparatus, which produces rapidly varying magnetic fields adapted to induce signals in the search coil, on an aircraft whereby a large area of the surface of the sea may rapidly be swept, thereby reducing the amount of equipment necessary for such purposes. By reason of the provision of the unresponsive period 194 of relay S described in the aforegoing, the mechanism is rendered unresponsive to a second signal occurring during the unresponsive time, thereby to eliminate the possibility of sweeping the mine by the employment of an aircraft, as an aircraft sweep will pass from the vicinity of the mine within such interval of time after inducing the first signal. In such case, therefore, response of the system to signals produced by sweep operations merely initiates the operation of the selector switch SS and causes the same to operate through a unit cycle of operations, thereby merely to arm the mine without causing a firing operation thereof.

Briefly stated in summary, the present invention contemplates the provision of a new and improved induction ground mine adapted to respond to changes in the vertical component of the magnetic field associated with a vessel in motion and having a mine firing mechanism adapted to fire and explode the mine beneath a vulnerable portion of the vessel when a pair of electrical signals of opposite polarities and occurring in predetermined time spaced relation are generated by the mine in accordance with changes in the magnetic field adjacent thereto controlled by the magnetic signature of the vessel and adapted to prevent the premature detonation of the mine by mine sweeping operations or as the result of a countermining operation.

While the invention has been described with respect to a particular example thereof, which gives satisfactory results, it will be understood by those skilled in the art, to which the invention appertains after understanding the invention, that various changes and modifications may be employed without departing from the spirit and scope of the invention and it is our intention, therefore, in the appended claims to cover all such changes and modifications.

The invention herein described and claimed may be manufactured and used by or for the Government of the United States of America for governmental purposes without payment of any royalties thereon or therefor.

What is claimed as new and desired to be secured by Letters Patent of the United States is:

1. In a mine of the character disclosed adapted to be planted on the bed of a body of water from a surface vessel, the combination of a mine casing, a drag plate for the mine adapted to retard the downward movement thereof as the mine descends through the water, means including a line for detachably securing the drag plate to the casing in such a manner as to cause the casing to be righted during the descent of the mine through the water, and means effective when the mine reaches a predetermined depth of submergence for disconnecting the drag plate from the casing.

2. In a mine of the character disclosed adapted to be planted on the bed of a body of water from a surface vessel, the combination of a mine casing, an elongated induction pickup coil adapted to generate electrical signals in accordance with changes in the component of the earth's magnetic field parallel to the axis thereof, a housing for said pickup coil adapted to support the coil in a vertical position on said casing, a drag plate for the mine adapted to retard the downward movement thereof as the mine descends through the water, means including a line for detachably securing said drag plate to said housing in such a manner as to cause the housing to be righted as the downward movement of the mine is retarded, means including a device responsive to the pressure of the water within which the mine is submerged for disconnecting the line from the housing when the mine reaches a predetermined depth of submergence, an explosive charge arranged within the casing, and means including a mine firing circuit controlled by said signals for detonating said charge.

3. In a mine of the character disclosed adapted to be planted on the bed of a body of water from a surface vessel, the combination of a mine casing, a search coil vertically disposed on said casing and adapted to generate electrical signals selectively in accordance with changes in the magnetic field adjacent thereto, means including a drag plate for righting the mine as it descends through the water whereby the search coil is disposed in a vertical position when the mine comes to rest on the bed of the water, an explosive charge arranged within said casing, a mine firing circuit controlled by electrical signals generated by said search coil and having means therein for detonating said charge, means controlled by the pressure of the surrounding water for partially arming the mine, means controlled by a first signal generated by said search coil for arming the mine, and means controlled by a second signal generated by the search coil and occurring in predetermined time spaced relation to said first signal for closing said firing circuit thereby to fire the mine.

4. In an induction ground mine of the character disclosed, the combination of means for inducing electrical signals of opposite polarities selectively in accordance with the magnetic signature of a vessel moving with respect thereto, a pair of relays, means controlled by said signals for selectively operating said relays in accordance with the polarities of said signals, means controlled by either of said relays for arming the mine for a predetermined interval of time, the means controlled by both of the relays for firing the mine when the second one of the pair of relays is operated during the interval of time in which the mine is armed.

5. In an induction ground mine of the character disclosed, the combination of means for generating electrical signals of opposite polarities selectively in accordance with the magnetic signature of a vessel moving with respect thereto, time measuring means adapted to measure a predetermined interval of time, means for operating the time measuring means, means controlled by the time measuring means for causing the mine to be armed for a predetermined fractional portion of the time measured by the time measuring means, means including a sensitive relay controlled by said signals for initiating the operation of the time measuring means when a signal is generated, and means controlled by said sensitive relay for firing the mine when a second signal of opposite polarity is generated during said armed time.

6. In a mine of the character disclosed adapted to be planted on the bed of a body of water from a surface vessel, the combination of a casing having roller supports thereon to facilitate launching of the mine from said vessel, means on said casing and responsive to changes in the vertical component of the magnetic field associated with a vessel for detecting movement of the vessel with respect to the mine, means for righting the mine as the mine descends through the water so that said detecting means is disposed in a vertical position when the mine comes to rest on the bed of the water, and means hydrostatically controlled for disconnecting said righting means from the mine when the mine reaches a predetermined depth of submergence.

7. In a mine of the character disclosed adapted to be planted on the bed of a body of water from a surface vessel, the combination of a mine case, an elongated induction pickup coil responsive to changes in the vertical component of the magnetic field associated with a vessel in motion for detecting the movement of the vessel with respect to the mine, a housing for said coil adapted to support the coil on said mine case in a vertical position, a drag plate for the mine adapted to retard the downward movement thereof as the mine descends through the water, a ring secured to one end of said housing, and a length of line adapted to be passed through said ring and secured at one end thereof to said drag plate and at the other end thereof to the other end of the housing whereby the pickup coil is moved into a vertical position when the line becomes taut as the downward movement of the mine is retarded.

8. In an induction ground mine of the character disclosed, the combination of means for inducing electrical signals of opposite polarities selectively in accordance with the magnetic signature of a vessel moving with respect thereto, a pair of relays, means controlled by said signals for selectively operating said relays in accordance with the polarities of said signals, time measuring means adapted to measure a predetermined interval of time, means for operating the time measuring means, means controlled by a first one of said pair of relays for arming the mine and for initiating the operation of said time measuring means, means controlled by the time measuring means for maintaining the operation of said first relay for a predetermined fractional portion of the time measured by the time measuring means, and means effective to fire the mine when the second one of the pair of relays is operated during the interval of time in which the mine is armed.

9. In an induction ground mine of the character disclosed, the combination of means for generating electrical signals of opposite polarities selectively in accordance with the magnetic signature of a vessel moving with respect thereto, a rotary selector switch adapted to be operated through a series of step-by-step movements thereof, means including a time delay mechanism operable in unit cycles and adapted to time the step-by-step movement of the selector switch, means controlled by the selector switch for causing said time delay mechanism to perform a sufficient number of unit cycles to step the switch through a unit cycle thereof, means controlled by the switch for causing the mine to be armed for a predetermined fractional portion of the time measured by the selector switch during one unit cycle thereof, and means including a sensitive relay controlled by said signals for initiating the operation of the switch when a first signal is generated and for firing the mine when a second signal of opposite polarity is generated during said armed time.

10. In a mine of the character disclosed adapted to be planted from a surface vessel and come to rest in a vertical position on the bed of a body of water, the combination of a casing having roller supports thereon to facilitate launching of the mine from the vessel, a search coil vertically disposed on said casing and adapted to generate electrical signals of opposite polarities selectively in accordance with changes in the magnetic field parallel to the axis of the coil, an explosive charge and detonator therefor arranged within the casing, and a mine firing mechanism and source of electrical power therefor supported on the casing and adapted to fire the detonator in response to a pair of signals of opposite polarities received from the search coil in predetermined time spaced relation.

11. In a mine of the character disclosed adapted to be planted from a surface vessel and come to rest in a vertical position on the bed of a body of water, the combination of a casing having roller supports thereon to facilitate launching of the mine from the vessel, an elongated induction pickup coil adapted to generate electrical signals selectively in accordance with changes in the magnetic field parallel to the axis of the coil, means for mounting the pickup coil in a vertical position on the casing, an explosive charge and detonator therefor arranged within the casing, and a mine firing mechanism and a source of electrical power therefor supported on the casing and adapted to fire the detonator in response to signals of predetermined character received from the pickup coil, thereby to explode the mine.

12. In an induction ground mine of the character disclosed, the combination of means for generating electrical signals selectively in accordance with the magnetic signature of a vessel moving with respect thereto, a rotary selector switch adapted to be moved in a series of step-by-step movements from an initial position through a unit cycle of operations as the switch operates and releases, circuit means including a sensitive relay controlled by said signals for initiating the operation of said switch, circuit means effective as operation of the switch is initiated for restoring the sensitive relay to an initial unoperated condition, a time delay mechanism operable in unit cycles, a slow releasing relay, circuit means including a pair of normally open contacts on the switch for operating said slow releasing relay as the switch operates, circuit means including a plurality of contacts on the slow releasing relay for maintaining the operation thereof, for releasing the switch thereby to move the switch ahead one step, and for operating said time delay mechanism in sequence as the slow releasing relay operates, circuit means including a pair of normally closed contacts on the time delay mechanism for releasing the slow releasing relay as the time delay mechanism operates and for operating the switch when said normally closed contacts close as the time delay mechanism releases and completes a unit cycle of operations, a mine firing circuit, circuit means including said switch for arming the firing circuit during the step-by-step movement of the switch, and circuit means controlled by said sensitive relay for operating the firing circuit when the sensitive relay is operated during said step-by-step movement of the switch.

13. In a submarine induction mine of the character disclosed, the combination of an induction pickup coil adapted to generate electrical signals of opposite polarities in accordance with the magnetic signature of a vessel moving with respect thereto, a polarized relay electrically connected to said coil and adapted to be operated in response to said signals, means controlled by said polarized relay for rendering the relay responsive to successive signals occurring in predetermined time spaced relation, a mine firing circuit, means controlled by the polarized relay for closing said firing circuit when the relay responds to a pair of said signals of opposite polarities occurring in said predetermined time spaced relation, means operable in response to an impulse of pressure received through the water, and means controlled by said pressure responsive means for opening said firing circuit and for forcibly restraining the polarized relay in a signal unresponsive condition for a predetermined period of time when the pressure response means operates.

14. In a submarine induction mine of the character disclosed, the combination of means for inducing electrical signals of opposite polarities selectively in accordance with the magnetic signature of a vessel moving with respect thereto, a pair of relays, means controlled by said signals for selectively operating said relays in accordance with the polarities of said signals, means controlled by either of said relays for maintaining the operation of a first of the relays after said first relay operates and for arming the mine for a predetermined interval of time during the operation of the first relay, means effective when the second one of the relays is operated during said predetermined interval of time for firing the mine, means operable in response to an impulse of pressure received through the water, and means controlled by said pressure response means for releasing said first relay when the pressure response means operates during said predetermined interval of time, thereby to disarm the mine.

15. In a submarine induction mine of the character disclosed, the combination of means for inducing electrical signals of opposite polarities selectively in accordance with the magnetic signature of a vessel moving with respect thereto, a pair of telephone relays, means including a polarized relay responsive to said signals for selectively operating said telephone relays in accordance with the polarities of said signals, means controlled by either of said telephone relays for maintaining the operation of a first of the telephone relays after said first telephone relay operates and for arming the mine for a first predetermined interval of time during the operation of the first telephone relay, means effective to fire the mine when the second one of the telephone relays is operated during said first predetermined interval of time, means operative in response to an impulse of pressure received through the water, and means controlled by said pressure responsive means for releasing said first telephone relay, thereby to disarm the mine, and for forcibly restraining the polarized relay in a signal unresponsive condition for a second predetermined interval of time, thereby to prevent the operation of the telephone relays during said second predetermined interval of time, when the pressure responsive means operates during the first predetermined interval of time.

16. In an induction mine of the character disclosed, the combination of a pickup coil adapted to generate electrical signals of opposite polarities selectively in accordance with the magnetic signature of a vessel moving with respect thereto, a pair of telephone relays, means including a polarized relay electrically connected to said coil and responsive to said signals for operating said telephone relays selectively in accordance with the polarity of the signals received thereby, a rotary stepping switch adapted to be stepped ahead from an initial unoperated position through a polarity of successive moved positions to said initial position, means including a time delay mechanism operable in unit cycles for timing the step-by-step movement of the switch, means controlled by either of said telephone relays for initiating the operation of the switch from said initial unoperated position when one of the telephone relays operates, means controlled by the switch for disconnecting said polarized relay from said coil and for restraining the polarized relay in an unresponsive condition until the switch steps ahead to a predetermined one of the moved positions thereof, a mine firing circuit, and means effective when said second telephone relay operates during a predetermined interval of time measured by the switch after reaching said predetermined moved position for closing said firing circuit.

17. In an induction mine of the character disclosed, the combination of an induction pickup coil adapted to generate electrical signals of opposite polarities selectively in accordance with the magnetic signature of a vessel moving with respect thereto, a rotary stepping switch adapted to be stepped ahead from an initial unoperated position through a plurality of successive moved positions to said initial position when the operation of the switch is initiated, means including a time delay mechanism operable in unit cycles for timing the step-by-step movement of the switch, means including a polarized relay responsive to said signals for initiating the operation of the switch when a first signal is generated, means controlled by the switch for restraining said polarized relay in a signal unresponsive condition until the switch reaches a predetermined one of the moved positions thereof, a mine firing circuit, and means including said polarized relay for closing said firing circuit when the polarized relay responds to a second signal of opposite polarity during a predetermined interval of time measured by the switch after reaching said predetermined moved position.

18. In an induction mine of the character disclosed, the combination of an induction pickup coil adapted to generate electrical signals of opposite polarities selectively in accordance with the magnetic signature of a vessel moving with respect thereto, a rotary stepping switch adapted to measure a predetermined interval of time when the operation of the switch is initiated, means including a polarized relay controlled by said signals for initiating the operation of the switch when a first signal is generated, means controlled by the switch for restoring said polarized relay to an initial unoperated position and for restraining the relay in said initial position for a predetermined fractional portion of the time measured by the switch, a mine firing circuit, and means including said polarized relay for closing said firing circuit when the polarized relay responds to a second signal of opposite polarity within the remaining fractional portion of the time measured by the switch.

19. In an induction mine of the character disclosed, the combination of a pickup coil adapted to generate electrical signals of opposite polarities selectively in accordance with increases and decreases in the strength of the magnetic field adjacent thereto, a pair of slow releasing relays, means including a polarized relay electrically connected to said coil and selectively responsive to said signals for operating said slow releasing relays selectively in accordance with the polarity of said signals, a pair of telephone relays adapted to be operated by said slow releasing relays respectively as the slow releasing relays operate, a rotary stepping switch adapted to measure a predetermined interval of time in response to the operation of either of said telephone relays, means controlled by the switch for restoring said polarized relay to an initial unoperated position and for restraining the relay in said initial position by a predetermined fractional portion of the time initially measured by the switch, means controlled by the switch for maintaining the operation of the telephone relay which initiates the operation of the switch for said predetermined interval of time, a third slow releasing relay adapted to be operated in response to the operation of either one of said pair of slow releasing relays, means controlled by said third slow releasing relay for restoring the polarized relay to an initial unoperated position and for restraining the polarized relay in said initial position for a second predetermined interval of time measured additively by the release times of the third slow releasing relay and said one of said pair of slow releasing relays which initiates the operation thereof, a mine firing circuit, and means effective when the other one of the telephone relays operates during the remaining fractional portion of the time measured by the switch for closing said circuit.

20. In an induction mine of the character disclosed, the combination of a pickup coil adapted to generate electrical signals of opposite polarities selectively in accordance with increases and decreases in the strength of the magnetic field parallel to the axis of the coil, a pair of slow releasing relays, means including a polarized relay electrically connected to said coil and responsive to said signals for operating said slow releasing relays selectively in accordance with the polarity of said signals, a pair of telephone relays adapted to be operated by said slow releasing relays respectively as the slow releasing relays operate, a rotary stepping switch adapted to measure a predetermined interval of time in response to the operation of either one of said telephone relays, a third slow releasing relay adapted to be operated in response to the operation of either one of said pair of slow releasing relays, means controlled by said third slow releasing relay for restoring the polarized relay to an initial unoperated position and for restraining the relay in said initial position for a predetermined period of time measured additively by the release times of the third slow releasing relay and said one of said pair of slow releasing relays which initiates the operation thereof, means controlled by the switch for maintaining the operation of the telephone relay which initiates the operation thereof for said predetermined interval of time measured thereby, a mine firing circuit, and means effective when the other one of the telephone relays operates during a predetermined fractional portion of the time measured by the switch for closing said circuit.

21. In a firing mechanism of the character disclosed adapted to close a mine firing circuit, the combination of means secured to the mine for generating electrical signals in accordance with the magnetic signature of a vessel moving with respect thereto, a rotary stepping switch having a plurality of contact banks and a combination of single-ended and double-ended wipers therefor, circuit means controlled by said signals and including a pair of said contact banks and a pair of single-ended and double-ended wipers respectively associated therewith for causing said switch to step ahead from an initial unoperated position through one complete rotation of the wipers, and circuit means including a second pair of said contact banks and a pair of single-ended wipers respectively associated therewith for partially closing said firing circuit continuously for an interval of time corresponding to a predetermined fractional portion of one complete rotation of the switch.

22. In a firing mechanism of the character disclosed adapted to close a mine firing circuit, the combination of means secured to the mine for generating electrical signals in accordance with the magnetic signature of a vessel moving with respect thereto, a rotary stepping switch having a plurality of contact banks and a combination of single-ended and double-ended wipers therefor, a battery, a first circuit means controlled by said signals and including said battery and a pair of said contact banks and a pair of single-ended and double-ended wipers respectively associated therewith for causing said switch to step ahead from an initial unoperated position through one complete rotation of the wipers as the switch operates and releases, a second circuit means including the battery and a time delay mechanism operable in unit cycles for timing the step-by-step movement of the switch wipers as the mechanism operates and releases, a slow releasing relay, a third circuit means including the battery and controlled by the switch for operating said relay as the switch operates, a plurality of contacts on the relay and included in said first and second circuit means for causing the switch and mechanism to operate and release in sequence as the relay operates thereby to prevent a peak current load on the battery, and a fourth circuit means including a second pair of said contact banks and a pair of single-ended wipers respectively associated therewith for partially closing said firing circuit continuously for an interval of time corresponding to a predetermined fractional portion of one complete rotation of the switch.

23. In a firing mechanism of the character disclosed adapted to close a mine firing circuit, a pair of relays, means including a polarized relay adapted to operate said pair of relays selectively in accordance with the polarity of signals received thereby, a rotary stepping switch having a plurality of contact banks and a combination of single-ended and double-ended wipers therefor, circuit means controlled by either of said pair of relays for causing the wipers of said switch to advance one step from an initial unoperated position to a first position thereof as one of said pair of relays operates, circuit means including a pair of said contact banks and a pair of single-ended and double-ended wipers respectively associated therewith for causing said switch to step ahead from said first position through one complete rotation of the wipers, circuit means controlled by the switch for maintaining the operation of said one of said pair of relays until the switch is restored to said initial position, circuit means including a second pair of said contact banks and a pair of single-ended wipers respectively associated therewith for partially closing said firing circuit continuously for an interval of time corresponding to a predetermined fractional portion of one complete rotation of the switch, and a pair of normally open contacts on each of said pair of relays and connected in series in the firing circuit whereby the firing circuit is closed when the other of said pair of relays operates during said interval of time.

24. An induction mine of the character disclosed adapted to be planted on the bed of a body of water from a surface vessel comprising, in combination, a casing, an elongated induction pickup coil supported on the casing, casing supporting means for orienting said coil with the magnetic axis thereof in substantial alignment with the vertical component of the earth's magnetic field when the mine is resting on a flat surface, means releasably secured to the mine for retarding the downward movement thereof as the mine descends through the water and for causing said orienting of the search coil during the downward descent, and hydrostatically controlled means for disconnecting said retarding means from the mine when the mine reaches a predetermined depth of submergence.

25. An induction mine of the character disclosed comprising, in combination, means for inducing electrical signals of opposite polarities selectively in accordance with the magnetic signature of a vessel moving with respect thereto, a pair of circuit means respectively operable by said signals selectively in accordance with the polarites thereof, and time measuring means operable in unit cycles by either one of said pair of circuit means upon operation thereof for rendering the first one of said circuit means to be operated effective to arm the mine for an interval of time measured by the time measuring means and for rendering the pair of circuit means cooperatively effective to fire the mine when the other one of the pair of circuit means is operated during said measured interval of time.

26. An induction mine of the character disclosed comprising, in combination, means for inducing electrical signals of opposite polarities selectively in accordance with the magnetic signature of a vessel moving with respect thereto, a pair of circuit means respectively operable by said signals selectively in accordance with the polarities thereof, a stepper switch having a plurality of banks of contacts and operable in unit cycles by either one of said pair of circuit means upon operation thereof, a mine firing circuit including at least one of said banks of contacts, and time measuring means including said stepper switch for rendering the first one of said pair of circuit means to be operated effective to arm said firing circuit for an interval of time measured by the time measuring means and for rendering the pair of circuit means cooperatively effective to operate the firing circuit when the other one of the pair of circuit means is operated during said measured interval of time.

* * * * *